US005548471A

United States Patent [19]

Roederer

[11] Patent Number: 5,548,471

[45] Date of Patent: Aug. 20, 1996

[54] CIRCUIT AND METHOD FOR SPARK-IGNITING FUEL

[75] Inventor: David A. Roederer, Frankfort, Ky.

[73] Assignee: Webster Heating and Specialty Products, Inc., Frankfort, Ky.

[21] Appl. No.: 279,552

[22] Filed: Jul. 25, 1994

[51] Int. Cl.[6] ..... H01T 15/00

[52] U.S. Cl. ..... 361/253; 361/263

[58] Field of Search ..... 361/253, 263; 315/222, 220, 209 T, 209 M; 123/621, 622, 606, 607, 650, 651

[56] References Cited

U.S. PATENT DOCUMENTS

| | | | |
|---|---|---|---|
| 875,035 | 12/1907 | DeYbarrondo . | |
| 3,035,108 | 5/1962 | Kaehni | 315/209 T X |
| 3,847,129 | 11/1974 | Canup | 315/209 T |
| 4,136,301 | 1/1979 | Shimojo et al. | 315/209 T |
| 4,242,078 | 12/1980 | Nelson et al. | 431/45 |
| 4,280,166 | 7/1981 | Jesse et al. | 361/253 |
| 4,329,628 | 5/1982 | Bohan, Jr. | 315/209 SC |
| 4,404,616 | 9/1983 | Miyanaka et al. | 361/253 |
| 4,414,491 | 11/1983 | Elliott | 315/282 |
| 4,418,375 | 11/1983 | Ober | 361/253 |
| 4,702,221 | 10/1987 | Tokura et al. | 315/209 T X |
| 4,918,569 | 4/1990 | Maeda et al. | 361/263 |
| 5,197,449 | 3/1993 | Okamoto et al. | 123/622 |

*Primary Examiner*—Fritz Fleming
*Attorney, Agent, or Firm*—Jansson & Shupe, Ltd.

[57] ABSTRACT

Disclosed is a DC-powered spark-generating circuit for igniting fuel. Such circuit has two primary windings on a common transformer core and a separate transistor controlling power to each primary winding. Each transistor has a gate and a drain and such gates and drains are "cross-coupled." That is, the gate of the first transistor is coupled to the drain of the second transistor and the drain of the first transistor is coupled to the gate of the second. Also disclosed is a method for spark-igniting fuel. Such method includes applying a voltage across an air gap at a first frequency, establishing an arc across the air gap and maintaining the arc at least until the fuel ignites. Such arc is maintained at a second frequency which different from (and preferably higher than) the first frequency.

8 Claims, 4 Drawing Sheets

FIG. 1
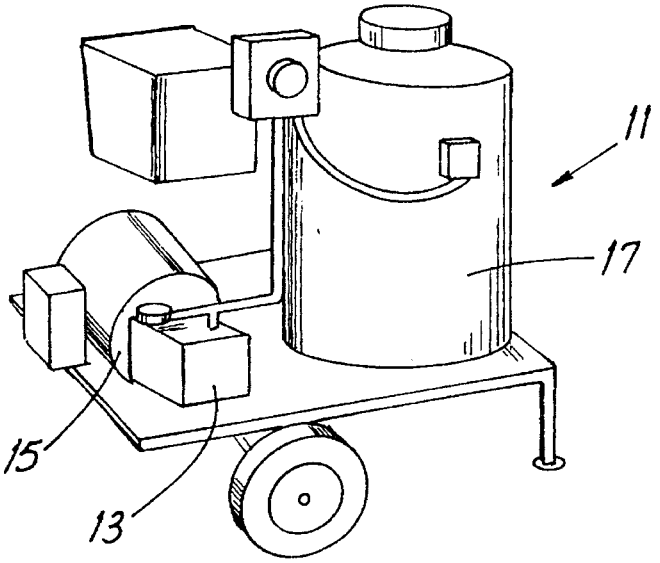
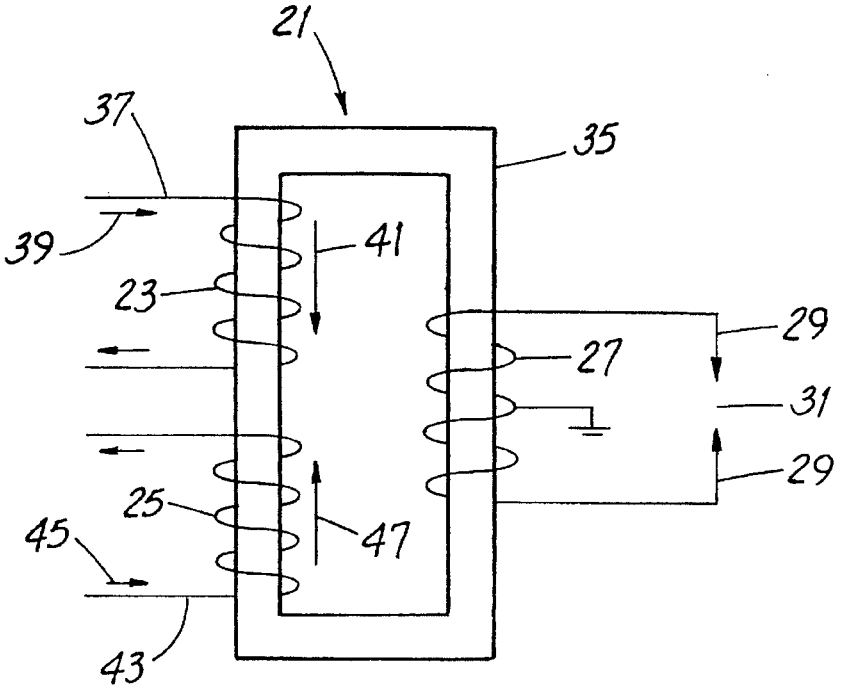
FIG. 3

CURRENT TRANSISTOR T1

CURRENT TRANSISTOR T2

DRAIN VOLTAGE TRANSISTOR T1

DRAIN VOLTAGE TRANSISTOR T2

OPEN CIRCUIT VOLTAGE ACROSS ELECTRODES

CURRENT TRANSISTOR T1

CURRENT TRANSISTOR T2

DRAIN VOLTAGE TRANSISTOR T1

DRAIN VOLTAGE TRANSISTOR T2

CURRENT BETWEEN ELECTRODES

CIRCUIT AND METHOD FOR SPARK-IGNITING FUEL

FIELD OF THE INVENTION

This invention relates generally to electricity and, more particularly, to electrical circuits used for combustion.

BACKGROUND OF THE INVENTION

From the time liquid and gaseous fuels came into use for heating, various techniques have necessarily been employed to ignite such fuel. Probably one of the earlier techniques involved using a taper or match for ignition.

Later (and particularly with gaseous fuels such as natural gas), gas-fired combustion equipment used a "standing" pilot light. Such pilot light burned continuously and was instantly available to ignite fuel. Disadvantages of a standing pilot light include unnecessary consumption of fuel, albeit in small amounts, and the practicality of using such standing pilot light only in stationary, permanent installations such as homes and offices.

A more recent innovation involves so-called spark generating circuits which lend themselves well to automatic, e.g., thermostatic, control. That is, when the thermostat calls for heat, early steps in the combustion cycle include opening a pilot valve to allow gas to flow to a pilot light and energizing a spark generating circuit to ignite the raw flowing gas. Such circuits are in wide use today and like heating systems using standing pilot lights, are used mostly in buildings.

Disadvantages of such spark generating circuits include the fact that most are configured to be powered by AC power, Yet another is that they are rather complex circuits and, relatively speaking, expensive. And although of generally modest size, they are physically rather large for applications involving portable heating equipment.

One type of such heating equipment is generally referred to as pressure cleaning equipment or "pressure washers." Such equipment is mounted "dolly-like" on wheels and uses pressurized water, cold or hot, to clean manufactured parts, automobile bodies, building surfaces and the like. The invention is particularly well suited for use with pressure washers.

One rather recent application for such pressure washers involves trucks which indiscriminately carry such diverse cargos as garbage and food products. In the New York City area, it was recently discovered that trucks hauling garbage would, after emptying and without benefit of intervening washing, pick up food products, e.g., fresh produce, for delivery.

It is understood that operators of trucks handling such things as garbage are being ordered to wash such trucks before loading food products. Washing is with hot, high-pressure water from a portable hot water spray machine of the type made by Aqua Blast Company of Decatur, Ind.

Certain patents in the field of spark generating circuits and in other fields are somewhat noteworthy. For example, U.S. Pat. No. 4,918,569 (Maeda et al.) depicts a spark ignition circuit powered from a DC source which is switched on and off as is the nature of power source control in circuits for internal combustion engine spark plugs.

The transformer has but a single primary winding, current to which is switched by a MOSFET. In turn, the MOSFET is controlled by a two-transistor driver circuit. There is also a detector for disabling the circuit based upon load current.

Switching the circuit on and off (a necessity of operation) requires additional components and circuitry which, in view of the invention, is not required in other applications.

U.S. Pat. No. 4,329,628 (Bohan, Jr.) involves an AC-powered spark ignition circuit. Such circuit has an energy storage capacitor which discharges through the primary winding of a spark transformer to develop a high, gas-igniting voltage at the transformer secondary. The energy storage capacitor is both charged and discharged during only one-half of the applied AC sine wave. To put it another way, the transformer core is "active" or in use only about one-half of the total operating time.

U.S. Pat. No. 4,414,491 (Elliott) is directed to a power supply for a discharge lamp. Such power supply uses transformer core saturation to control the frequency at which the two-transistor invertor circuit operates. The transformer core has what is described as a shunt flux flow path with an air gap. For certain applications not involving a discharge lamp, the transformer is unnecessarily complex.

An improved igniter circuit overcoming some of the aforementioned problems and shortcomings would be an important advance in the art.

OBJECTS OF THE INVENTION

It is an object of the invention to provide a new circuit and method for spark-igniting fuel which overcomes some of the problems and shortcomings of the prior art.

Another object of the invention to provide a new circuit and method for spark-igniting fuel which operates from a vehicle electrical system.

Another object of the invention to provide a new circuit and method for spark-igniting fuel powered from a DC source which is continuously-applied when the circuit is in operation.

Another object of the invention to provide a new circuit and method for spark-igniting fuel which uses a relatively simple transformer structure.

Another object of the invention to provide a new circuit and method for spark-igniting fuel which makes more efficient use of the transformer structure. How these and other objects are accomplished will become more apparent from the following descriptions and from the drawing.

SUMMARY OF THE INVENTION

The invention involves a DC-powered spark-generating circuit for igniting fuel such as atomized fuel oil. Such circuit includes (a) a transformer with a first primary winding and a secondary winding on a common core and (b) a first transistor controlling power to the primary winding.

In the improved oscillatory circuit, the transformer includes a second primary winding and the circuit has a second transistor controlling power to the second primary winding. Each transistor has a gate and a drain and the gate of the first transistor is coupled to the drain of the second transistor.

More specifically, such gates and drains are "cross-coupled." That is, the gate of the first transistor is coupled to the drain of the second transistor and the drain of the first transistor is coupled to the gate of the second. The circuit is thereby in a push-pull configuration and oscillates. Preferably, such gate-and-drain coupling is by a separate resistor-capacitor coupling network for each gate/drain combination.

In other aspects of the inventive circuit, the gate of the first transistor is also coupled to the second primary winding. Similarly, the gate of the second transistor is coupled to the first primary winding. During operation, the primary windings alternate as to conducting and non-conducting state. That is, when the first primary winding is conducting, the second primary winding is in a non-conducting state. And when the second primary winding is conducting, the first primary winding is in a non-conducting state.

As each transistor conducts, the transformer core flux increases and over a short period of time, such core becomes substantially saturated with magnetic flux. As saturation approaches, the inductance of the transformer primary falls rapidly and the current of the transistor controlling the particular winding causing saturation also rises. In consequence, the voltage at the drain of that transistor, e.g., the first transistor, is at a first, relatively high drain voltage.

Such relatively high drain voltage is coupled to the gate of the second transistor, turning it on. The second transistor thereupon conducts and its drain is thereupon at a relatively low second drain voltage. That is, the first drain voltage is higher than the second drain voltage.

The circuit also includes a feature preventing electromagnetic energy in the core from being dissipated as heat in the resistance of the transformer winding and in resistors in the circuit. Clearly, such energy dissipation is to be prevented if energy is to be transferred to the transformer secondary and thence to a spark gap to ignite fuel.

In the inventive circuit, each primary winding is coupled to a DC power supply, e.g., +12 VDC, and a diode is interposed between each primary winding and the power supply. Stored transformer energy (which would otherwise change from flux to electrical current circulating in the transformer primary windings) is forced to the secondary winding by such diodes.

Other aspects of the invention include a new method for spark-igniting fuel. Such method includes applying a voltage across an air gap at a first frequency, establishing an arc across the air gap and maintaining the arc at least until the fuel ignites. Such arc is maintained at a second frequency which different from (and preferably higher than) the first frequency.

The new method is preferably practiced using an ignition circuit having a transformer with a secondary winding defining a tuned circuit having a resonant frequency. That is, the inductance of such secondary winding (represented by the symbol "L") and the turn-to-turn capacitance of such winding (represented by the symbol "C") form a resonant LC circuit.

The arc maintaining step includes maintaining the arc at a second frequency substantially equal to the resonant frequency. The two transistors controlling the primary windings of the transformer are switched at a frequency and the voltage applying step includes switching such transistors at a switching frequency substantially equal to the first frequency.

In a preferred method, the second frequency is higher than the first frequency, preferably at least twice the first frequency. Most preferably, the second or resonant frequency is several times the first or switching frequency.

Other details of the invention are set forth in the following detailed description and in the drawing.

BRIEF DESCRIPTION OF THE DRAWING

FIG. 1 is a representative perspective view of a pressure washing machine, an exemplary product with which the inventive circuit and method can be used.

FIG. 3 is a representative view of the transformer used with the circuit of FIG. 2.

The graphs of FIGS. 4–8 correspond in time which advances left-to-right along the horizontal axis of each graph. Such graphs depict electrical phenomenon when the secondary of the circuit of FIG. 2 is in the open circuit (non-sparking) mode.

Figure 2:
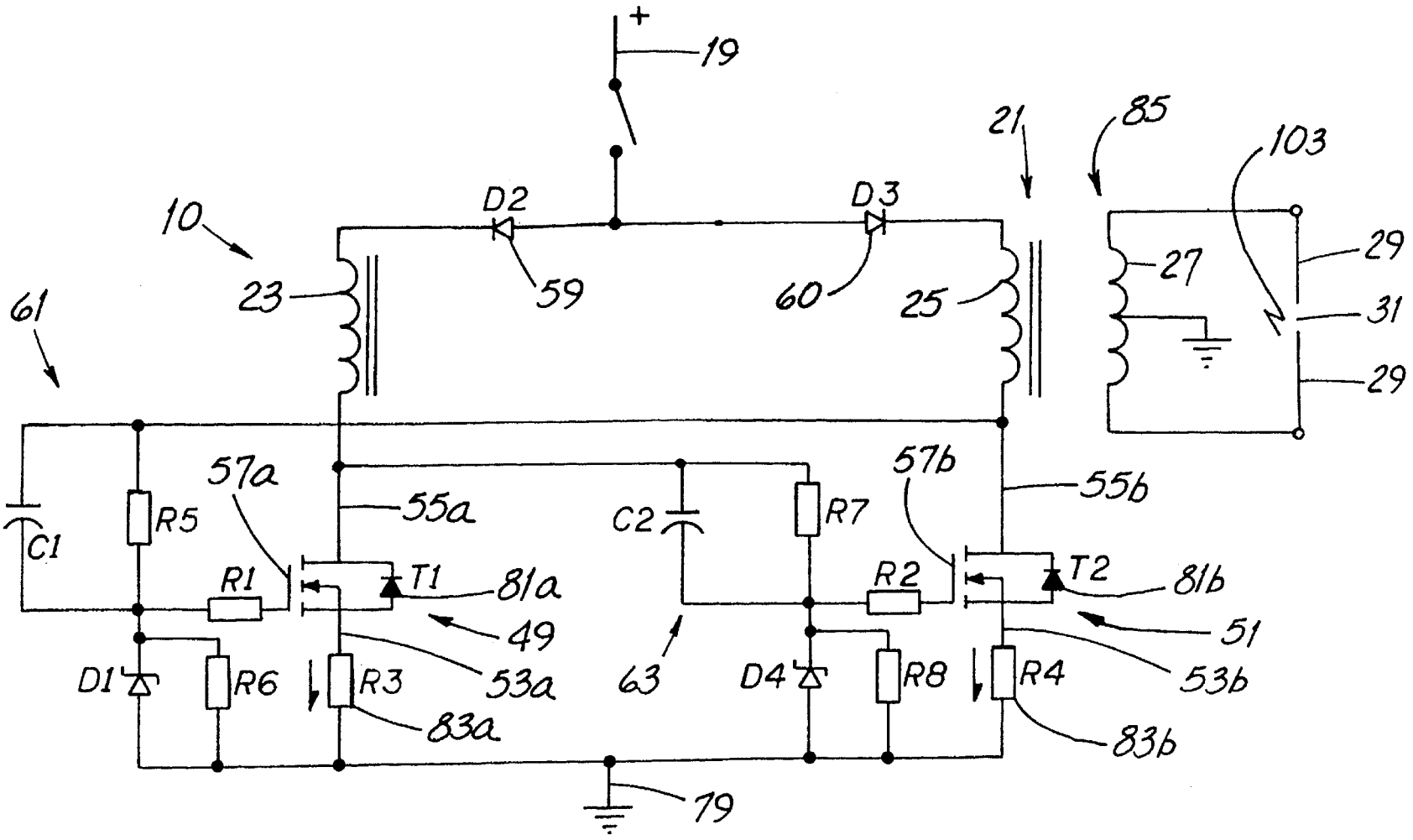
FIG. 2 is a schematic diagram of the new circuit.
Figure 4:
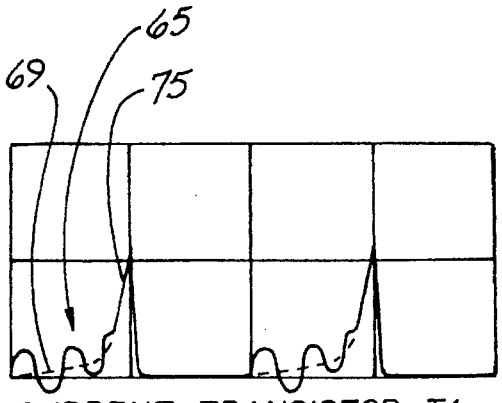

FIG. 4 is a graph showing current flowing through the first MOSFET T1 of the circuit shown in FIG. 2.

Figure 5:
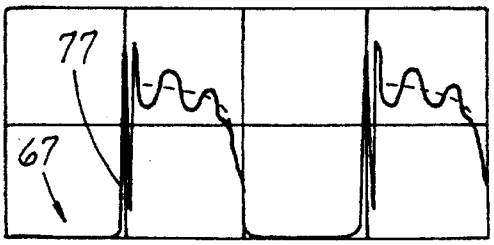

FIG. 5 is a graph showing voltage across the MOSFET T1.

Figure 6:
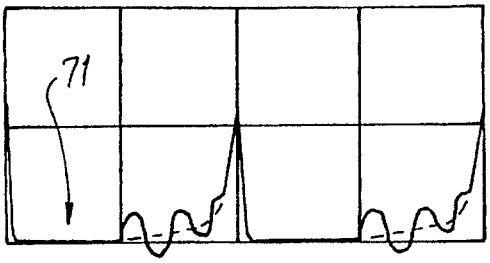

FIG. 6 is a graph showing current flowing through the second MOSFET T2 of the circuit shown in FIG. 2.

Figure 7:
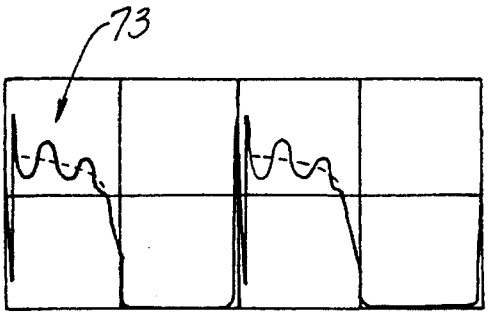

FIG. 7 is a graph showing voltage across the MOSFET T2.

Figure 8:
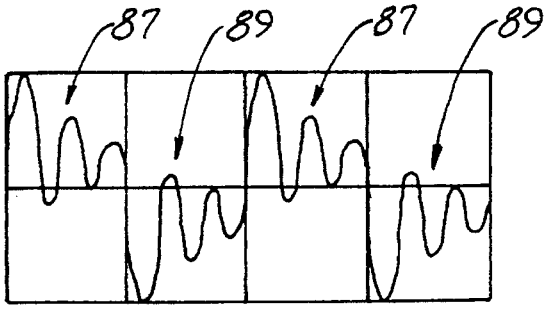

FIG. 8 is a graph showing the open circuit voltage across the electrodes of the circuit of FIG. 2.

The graphs of FIGS. 9–13 correspond in time which advances left-to-right along the horizontal axis of each graph. Such graphs depict electrical phenomenon when the secondary of the circuit of FIG. 2 is in the short circuit (sparking) mode. Since the oscillation frequency of the circuit is higher in the short circuit mode, the "box" time intervals shown in FIGS. 9–13 are shorter than those of FIGS. 4–8.

Figure 9:
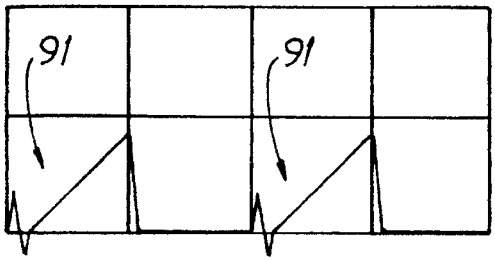

FIG. 9 is a graph showing current flowing through the first MOSFET T1 of the circuit shown in FIG. 2.

Figure 10:
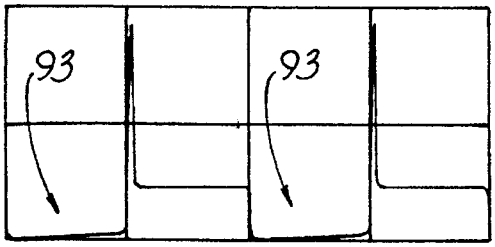

FIG. 10 is a graph showing voltage across the MOSFET T1.

Figure 11:
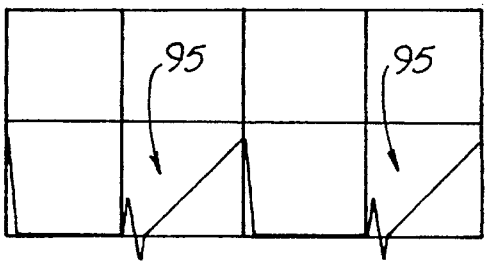

FIG. 11 is a graph showing current flowing through the second MOSFET T2 of the circuit shown in FIG. 2.

Figure 12:
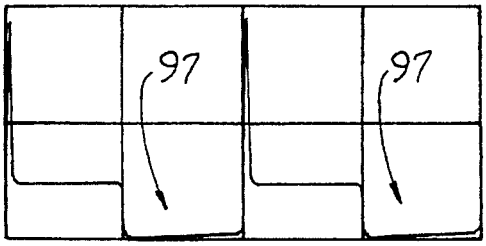

FIG. 12 is a graph showing voltage across the MOSFET T2.

Figure 13:
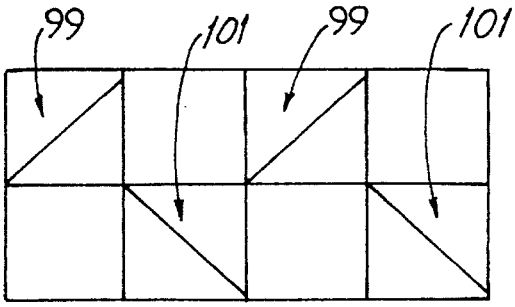

FIG. 13 is a graph showing the open circuit voltage across the electrodes of the circuit of FIG. 2.

DETAILED DESCRIPTION OF PREFERRED EMBODIMENTS

Before describing the inventive igniter circuit 10, it will be helpful to have a more complete understanding of an application (certainly not the only application) for which the circuit 10 may be used. Referring to FIG. 1, a pressure washer 11 is dolly mounted and has a water pump 13 and a prime mover 15, e.g., an electric motor, for driving the pump 13. When the pump 13 is driven and the controls properly manipulated, water heated in the tank 17 is expelled through a wand-mounted nozzle (not shown). A burner (not shown) and the circuit 10 used to ignite such burner are beneath the tank 17.

Referring next to FIG. 2, a general description of the operation of the igniter circuit 10 will be provided. Such circuit 10 operates from a 12 volt DC source 19 (such as a motor vehicle battery) and uses a transformer 21 to significantly "step up" the voltage from the transformer primary windings 23, 25 to the secondary winding 27. Such high voltage is applied to a pair of electrodes 29 which are spaced apart slightly to define an air gap 31. The high voltage spark "jumps the gap 31" and in so doing, ignites nearby fuel. In the pressure washer application described above, the fuel is atomized kerosene, fuel oil or the like. The operation of the circuit 10 to ignite fuel is not unlike the operation of the ignition circuit and spark plug to ignite atomized gasoline, all as used in an automobile engine.

Persons of ordinary skill in the art recognize the general understanding that transformers do not operate on direct current (DC) power. As described in detail below, the new circuit 10 directs DC power alternately along two paths so that, to the transformer 21, it "looks like" alternating current (AC) power.

In the following discussion, reference is made to "open circuit" and "short circuit" operating conditions and the new igniter circuit 10 operates under both such conditions. The open circuit condition is that prevailing between the instant 12 VDC power is applied to the circuit 10 and the instant the air in the air gap 31 ionizes and the spark jumps such air gap 31 and establishes the fuel-igniting arc. This interval may be a second or two.

The short circuit condition is that prevailing between the instant the spark jumps the air gap 31 to establish an arc and the instant at which the 12 VDC power is removed from the circuit 10 if the circuit 10 is connected for intermittent powering. There are several ways to operate the circuit 10.

In a pressure washer application, one way is to use a separate control which initiates the circuit 10 whenever the operator actuates a spray nozzle to spray hot water. Another way is to use a manual "start" button and the manually-operated contact 33 symbolically represents such button or any of the several available ways to start the circuit 10.

Referring also to FIG. 3, the transformer 21 used with the circuit 10 has first and second primary windings 23, 25, respectively, wound one atop the other on the iron core 35 in a flux-opposing relationship. (Windings 23, 25 are shown "side-by-side" for easier understanding.) That is, when DC current flows into the winding 23 along the lead 37 and in the direction of the arrow 39, such current produces electromagnetic flux illustrated to propagate around the core 35 in the direction of the arrow 41.

On the other hand, when DC current flows into the winding along the lead 43 and in the direction of the arrow 45, such current produces electromagnetic flux illustrated to propagate around the core 35 in the direction of the arrow 47. As will be seen, the circuit 10 is uniquely arranged so that the DC currents represented by the arrows 39, 45 are caused to flow alternately at relatively high frequency.

Flux propagating in opposite directions around the core 35 cuts across the secondary winding 27 in opposite directions. Therefore, an AC voltage is induced across the electrodes 29. And since the ratio of the number of turns of the secondary winding 27 to the number of turns of either primary winding 23, 25 is quite high, such AC voltage across the electrodes 29 is quite high in the open circuit condition, i.e., about 10,000 VAC, for rapid air ionization and sparking. In the preferred igniter circuit 10, the turns ratio is in the range of 300:1 to 400:1 with about 340:1 being highly preferred.

It should be appreciated that the amount of flux in the transformer core 35 is a function of the number of turns of the windings 23, 25 and the magnitude of the current flowing through the windings 23, 25. However, the core 35 is not a "flux pipeline" of infinite capacity. Quite the contrary. There is a limit to the amount of flux a given transformer core 35 can carry and when that limit is reached, the core 35 is said to be "saturated." Core saturation is used in a unique way in the circuit 10.

A more detailed description of the operation of the circuit 10 follows. However, such description will be more easily understood by first having a general understanding of how a metal oxide semiconductor field effect transistor (MOSFET) operates. Referring again to FIG. 2, each MOSFET 49, 51 is of the N-channel type and has a source 53*a*, 53*b*, respectively, a drain 55*a*, 55*b*, respectively, and a gate 57*a*, 57*b*, respectively. Each MOSFET 49, 51 can be considered as a switch which can be open or closed to block electric current or permit current to flow.

If a MOSFET, e.g., MOSFET 49, is conducting (such MOSFET 49 is functioning as a closed switch), current flows from the 12 VDC supply 19, through a diode 59 and a winding 23, and through the drain 55*a* to the source 53*a*. On the other hand, when the MOSFET 49 functions as an open switch, no current flows. Whether or not either MOSFET "switch" is open or closed depends upon the voltage at the gate 57.

If the voltage at the gate 57 is zero or negative, the MOSFET 49, 51 is nonconductive, i.e., the "switch" is open. If the gate voltage rises to an appropriate positive value, e.g., 5 VDC or so, the MOSFET 49, 51 conducts and functions as a closed switch.

The circuit 10 includes two MOSFETs 49, 51 in what is referred to as a push-pull configuration. "Push-pull" is another way of referring to the alternating conduction of the two MOSFETs 49, 51 as described above. Each MOSFET 49 and 51 controls the flow of current through a separate primary winding 23 and 25, respectively, of the ignition transformer 21. The drain 55 of each MOSFET 49, 51 is coupled to the gate 57 of the other MOSFET 51, 49 through a resistor-capacitor coupling network 61 or 63. This arrangement provides positive feedback, with a loop gain of much greater than one. The circuit 10 oscillates as the MOSFETs 49, 51 are alternately closed and opened.

From the foregoing, it will be appreciated that generally stated, the voltage at the drain 55*a* of a MOSFET, e.g., MOSFET 49, controls the gate 57*b* of the other MOSFET 51 and vice versa. The specification below includes an explanation of how and why the drain voltage of a particular MOSFET 49, 51 goes up and down.

The circuit 10 uses characteristics of the transformer 21 (along with selected values of resistors and capacitors) to control the rate at which the circuit 10 oscillates.

Continuing reference to FIG. 2 and referring also to FIGS. 4 and 5, this part of the specification assumes that a "switch" is closed and that MOSFET 49 is conducting current as shown in the region 65 of FIG. 4. During current conduction, there is very little voltage "drop" across the MOSFET 49 (measured from drain 55*a* to source 53*a*) and such voltage is as shown in the region 67 of FIG. 5. As illustrated in the region 65 of FIG. 4, the average current flowing through the MOSFET 49 (as represented by the dashed line 69) increases rather gradually until the transformer 21 saturates.

While the MOSFET 49 is conducting current, the current flowing through the MOSFET 51 is essentially zero as shown in the region 71 of FIG. 6. And the drain-to-source voltage across MOSFET 51 is relatively high (but declining) as shown in the region 73 of FIG. 7.

Upon saturation due to rising average current flowing through MOSFET 49, the transformer inductance falls sharply with an attendant sharp rise in MOSFET current as shown at 75. The drain voltage of the conducting MOSFET 49 also rises rapidly as shown at 77. Since high drain voltage at MOSFET 49 controls "gating" of the MOSFET 51, the latter turns on and the MOSFET 49 turns off.

While the MOSFET 51 is conducting, its current and voltage replicate those of the MOSFET 49. In other words, its current and voltage are like those shown in regions 65 and 67 of FIGS. 4 and 5, respectively.

At the transition when one MOSFET, e.g., MOSFET 49, stops conducting and the other MOSFET, e.g., MOSFET 51 starts conducting, a large amount of electromagnetic energy (transferred to the transformer core 35 by the primary windings 23, 25) is stored in the core 35. But for the inclusion of a pair of diodes 59, 60 blocking negative current flow, that energy stored in the core 35 would cause the drain 55*a* or 55*b* of the then-conducting MOSFET 49, 51 to be driven negative with respect to ground 79.

The diode 81*a*, 81*b* internal to a MOSFET 49, 51, respectively, would conduct and the energy would be dissipated in the resistance of the winding 23, 25, the diodes 81*a*, 81*b*, and the source resistors 83*a*, 83*b*. The blocking diodes 59, 60 prevents such "back feeding" and causes the electromagnetic energy to be transferred to the transformer secondary 85.

The transformer secondary 85 is a tuned circuit and in a highly preferred embodiment, the tuned frequency of such secondary 85 is several times the switching frequency of the MOSFETs 49 and 51. As alternating conduction of MOSFETS 49 and 51 continues, an open circuit AC voltage is produced across the electrodes 29. (The open circuit voltage is the electrode-to-electrode voltage before the air in the gap 31 between the electrodes 29 is ionized and before current flows therebetween.)

The open circuit electrode voltage in the regions 87 of FIG. 8 results from conduction of MOSFET 49 while the electrode voltage in the regions 89 results from conduction of MOSFET 51. The open circuit electrode voltage is high, on the order of 30,000 VAC peak-to-peak, and with the component values mentioned below, the frequency is in the range of 2–4 KHz. During open circuit operation, the current is a very low "trickle" current.

It is now assumed that the aforementioned open circuit electrode voltage has ionized the air in the gap 31 between the electrodes 29. When that occurs, there is a substantial reduction in the resistance between the electrodes 29. As a result, the current flowing between the electrodes 29 increases dramatically to about 20–40 milliamperes peak-to-peak and at that time, the maximum current in the primary windings 23, 25 is about 12 amperes. At the same time, the voltage across the electrodes 29 drops sharply to about 3000 VAC. The transformer secondary 85 is then said to be short-circuited and the impedance of the transformer secondary 85 is sharply reduced.

The reason for this sharp reduction in inductive impedance is better understood by considering an inductive impedance equation. In such equation, inductance equals [a constant x turns x flux], all divided by current. Since the value of current appears in the denominator (and recalling the aforementioned sharp increase in the current flowing between the electrodes 29), it is now apparent why the impedance of the secondary 85 is sharply reduced.

The impedance of the primary windings 23, 25 is therefore also reduced and the MOSFETs 49 and 51 commence switching at a frequency higher than that in the open circuit mode. In the illustrated circuit 10, the frequency of switching when the transformer 21 is short-circuited is in the range of 3–5 KHz.

FIGS. 9–12 show the voltage and current of MOSFET 49 and 51 and FIG. 13 shows the output current, all while the transformer secondary 85 is short circuited and output current flows between the electrodes 29. Regions 91 and 93 of FIGS. 9 and 10 show the current and drain voltage, respectively, of MOSFET 49 while such MOSFET 49 is conducting and regions 95 and 97 of FIGS. 11 and 12 show the current and drain voltage, respectively, of MOSFET 51 while it is conducting. FIG. 13 shows the current between electrodes 29. The current in the regions 99 is when the MOSFET 49 is conducting while the current in the regions 101 is when the MOSFET 51 is conducting.

Current flowing between the electrodes 29 (as shown in FIG. 13) manifests itself as a hot spark (represented by the symbol 103) across the air gap 31. In the exemplary application of the circuit 10 involving the pressure washer 11, the spark 103 is closely proximate atomized fuel and such fuel ignites. Upon ignition, the operator opens the contact 33 since combustion is self-sustaining until the fuel supply is shut off.

To recap, the new igniter circuit 10 has a number of features which include a dual primary winding 23, 25 with current-controlling transistors 49, 51 operating in push-pull oscillation. The frequency of oscillation is a function of the characteristics of the ignition transformer 21 as well as of the values of the resistors and capacitors in the gate R-C coupling networks 61, 63.

The diodes 59, 60 alternately block negative current flow in the primary windings 23, 25 and cause high energy transfer to the transformer secondary 85. It should be noted that conventional "flyback" ignition circuits use only about one-half of the flux-carrying capability of the core since flux does not reverse. In the depicted push-pull configuration, flux reverses and the flux-carrying capability of the core 35 is used substantially continuously.

In the new circuit 10, output frequency in the short-circuit ("arc established") mode is higher than the output frequency in the open-circuit mode. And there is an automatic, substantial drop in secondary output voltage after the ignition arc is established.

Other aspects of the invention include a new method for spark-igniting fuel. Such method includes applying a voltage across an air gap 31 at a first frequency, establishing an arc 103 across the air gap 31 and maintaining the arc 103 at least until the fuel ignites. Such arc 103 is maintained at a second frequency which different from (and preferably higher than) the first frequency.

The new method is preferably practiced using an ignition circuit 10 having a transformer 21 with a secondary winding 27 defining a tuned circuit having a resonant frequency. That is, the inductance of such secondary winding 27 (represented by the symbol "L") and the turn-to-turn capacitance of such winding 27 (represented by the symbol "C") form a resonant LC circuit.

The arc maintaining step includes maintaining the arc 103 at a second frequency substantially equal to the resonant frequency. The two transistors 49, 51 controlling the primary windings 23, 25, respectively, of the transformer 21 are switched at a frequency and the voltage applying step includes switching such transistors 49, 51 at a switching frequency substantially equal to the first frequency.

In a preferred method, the second frequency is higher than the first frequency, preferably at least twice the first frequency. Most preferably the second or resonant frequency is several times the first or switching frequency.

The following components have been found useful in the circuit 10:

| COMPONENT | VALUE |
|---|---|
| R1, R2, R6, R8 | 1 Kohm |
| R5, R7 | 680 ohm |
| R3, R4 | 0.1 ohm |
| C1, C2 | 0.0015 μF |
| Primary windings | 30 turns each |
| Secondary winding | 5100 turns |
| D1, D4 | Zener Diode |
| D2, D3 | Conventional Diode |

While the principles of the invention have been shown and described in connection with a specific embodiment, it is to be understood clearly that such is by way of example and is not limiting.

What is claimed:

1. In a DC-powered spark-generating circuit for igniting fuel and including (a) a transformer with a primary winding and a secondary winding on a common core and (b) a transistor controlling power to the primary winding, the improvement wherein:

the primary winding is a first primary winding;

the transistor is a first transistor;

the transformer includes a second primary winding;

the circuit has a second transistor controlling power to the second primary winding;

each primary winding has a terminal connected through a separate blocking diode to a .positive voltage source;

each transistor has a gate and a drain;

the first primary winding has another terminal connected to the drain of the first transistor;

the second primary winding has another terminal connected to the drain of the second transistor;

the gate of the first transistor is coupled to the drain of the second transistor;

the secondary winding is the sole secondary winding and is center tapped to ground; and both primary windings transfer electromagnetic flux through the core to the secondary winding.

2. The circuit of claim 1 wherein:

the gate of the first transistor is also coupled to the second primary winding; and the second primary winding is in a non-conducting state.

3. The circuit of claim 2 wherein:

the transformer is the sole transformer in the circuit;

the core is substantially saturated with magnetic flux;

the drain of the first transistor is at a first drain voltage;

the drain of the second transistor is at a second drain voltage; and the first drain voltage is higher than the second drain voltage.

4. The circuit of claim 1 wherein the gate of the first transistor is coupled to the drain of the second transistor by a resistor-capacitor coupling network, whereby the circuit is an oscillatory circuit.

5. The circuit of claim 1 wherein the gate of the first transistor is coupled to the drain of the second transistor by a resistor-capacitor coupling network.

6. A method for spark-igniting fuel and including the steps of:

providing an ignition circuit including a transformer with a secondary winding having a resonant frequency, the secondary winding being connected to electrodes having an air gap therebetween;

applying a voltage across the air gap at a first frequency less than the resonant frequency;

establishing an arc across the air gap; and maintaining the arc at least until the fuel ignites, such arc being maintained at a second frequency substantially equal to the resonant frequency.

7. The method of claim 6 wherein the transformer has a pair of transistors connected thereto and the voltage applying step includes switching the transistors at a switching frequency substantially equal to the first frequency.

8. The method of claim 7 wherein the second frequency is at least twice the first frequency.

* * * * *